United States Patent [19]

De Carvalho Vianna

[11] 4,193,143

[45] Mar. 18, 1980

[54] SWIMMING POOL STEPS AND WATER CIRCULATING ARRANGEMENT FOR SWIMMING POOLS

[76] Inventor: Claudio Werneck De Carvalho Vianna, Rua Santa Alexandrina, 900 Apt. 101, Rio Comprido Rio de Janeiro, Brazil

[21] Appl. No.: 846,097

[22] Filed: Oct. 27, 1977

[51] Int. Cl.[2] ..... E04H 3/20

[52] U.S. Cl. ..... 4/172.17; 210/169

[58] Field of Search ..... 4/172, 172.15–172.18, 4/173 R, 178, 180, 181; 210/169; 15/337, 410, 411

[56] References Cited

U.S. PATENT DOCUMENTS

| | | | |
|---|---|---|---|
| 2,623,234 | 12/1952 | Brown | 15/410 X |
| 2,688,148 | 9/1954 | Vance | 15/337 |
| 3,036,712 | 5/1962 | Barbara | 4/172.17 X |
| 3,090,489 | 5/1963 | Smith | 4/172.17 |
| 3,139,628 | 7/1964 | Richards | 4/172.17 |
| 3,806,964 | 4/1974 | Vanegas et al. | 4/180 |

FOREIGN PATENT DOCUMENTS

| | | | |
|---|---|---|---|
| 2255163 | 5/1973 | Fed. Rep. of Germany | 210/169 |

*Primary Examiner*—Stuart S. Levy

*Attorney, Agent, or Firm*—Beveridge, DeGrandi, Kline and Lunsford

[57] ABSTRACT

A set of swimming pool steps of which the handrails are pipe members, one being part of the suction line of the water circulating and purifying systems and the other being the return line for the purified water. The handrail comprising the return line has its lower end blocked and is formed with one and preferably a plurality of lateral ports for injecting the purified water into the swimming pool in a direction substantially parallel to the wall of the pool where the steps are mounted. This arrangement not only makes perforation of the impermeable walls of the pool unnecessary but also provides a series of vertical streams of purified water in the pool to provoke circulation of the complete contents of the pool so as to permit improved mixture between the re-circirculated water and the water already in the pool.

5 Claims, 4 Drawing Figures

SWIMMING POOL STEPS AND WATER CIRCULATING ARRANGEMENT FOR SWIMMING POOLS

The present invention refers to swimming pool steps and arrangement for effecting efficient chlorination of swimming pools using a minimum of chlorine.

The circulation of water in swimming pools is usually effected by connecting the pump, filtration and purification units to a drain at the bottom of the pool and a plurality of purified water injection points formed in the walls of the pool slightly above the waterline. In order to avoid intensive localized chlorination, it is generally required that a plurality of said injection points be distributed at specific spacing around the pool. In addition to the above it is usually necessary to have a closable coupling connected to the suction side of the filter and purification system, for connection thereto of a suction line for cleaning specific areas within the pool.

Conventional pools of the type mentioned above require therefore that the bottom and the side walls be perforated for the withdrawal and injection of the water. Since this means perforation of the impermeable parts of the structure forming the pool, this means that one of the aspects which weighs heavily in the cost thereof is the actual installation of the hydraulic circuits.

An object of the present invention is to provide new swimming pool steps, the lateral handrails of which serve as the suction and pumping lines of the circulation system.

Apart from the above it has been found that if the water injection points are distributed along one of the handrails and directed generally parallel to the corresponding side wall of the pool, the water injected creates a mass displacement of the water within the pool, which ensures a constant and effective mixture of the injected water with all the water contained within the pool. This is so effective that with a set of single steps relatively large private pools can effectively be chlorinated without any undue concentration of chlorine in the area of the steps. When the water circulation system is functioning, the entire upper surface of the pool, when seen from above, is covered by a large number of small and ever-moving eddies. This prevents the procreation of micro-organisms and there is an almost complete avoidance of slime even over extended periods without draining the pool.

The suction line, that is to say the other handrail of the steps, extends to the bottom of the pool where it is provided with a telescopic end for accommodating itself to pools of different depths. This telescopic end is provided with lateral openings for the water entering the suction line for conduction to the pump, filter and purification system. Slightly above the water level of the suction handrail, there are means for connection of a manually operated suction line, said connection preferably being a T having a closure cover for normal operation which is replaceable by the connection end of the suction line. This end is cut at 45° so that on introducing it into the T, it closes off the lower end of said handrail with respect to the suction flow from the bottom of the pool, replacing it with flow along the said line.

Although it is preferred to obtain the mass displacement of the water within the pool by means of a plurality of water injection points along one of the handrails of the steps, thus making perforation of the pool structure unnecessary, it will be appreciated that the new concept of mass displacement can be applied for a pool having conventional type injection points, but all formed substantially one above the other in one or two side wall(s) of the pool adjacent the corner(s) thereof.

The invention will now be described in greater detail, by way of example, with reference to the drawings in which.

Figure 1:
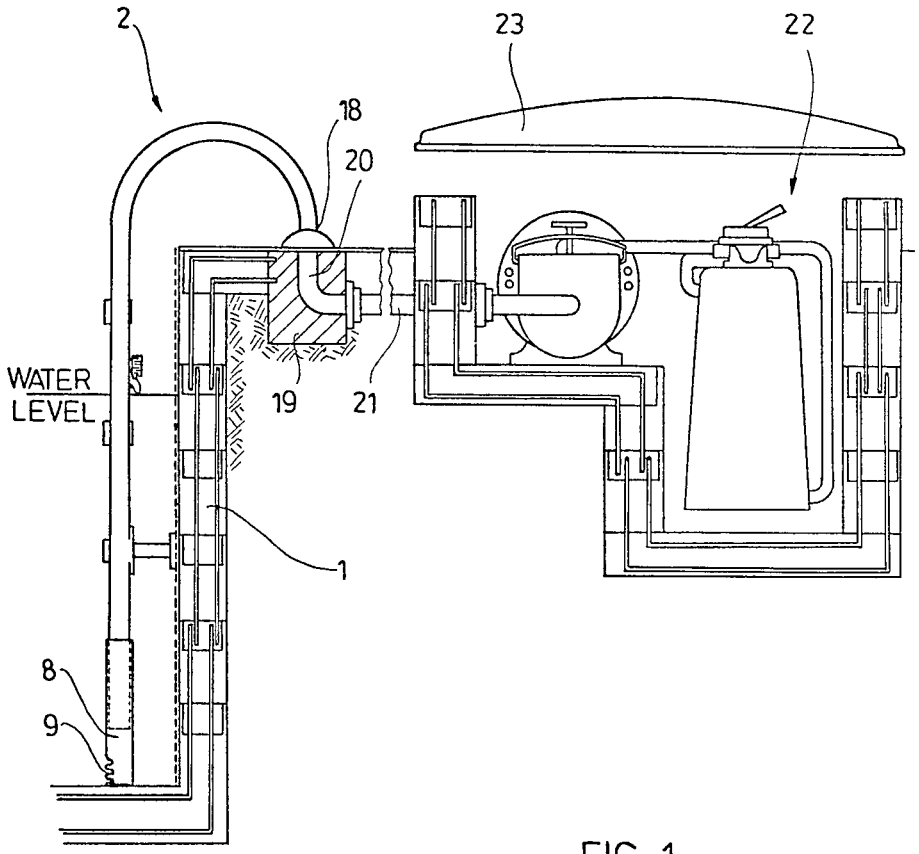
FIG. 1 is a cross-section through the wall of a swimming pool and the circulation system, showing steps according to the present invention.

Referring now to the drawings, one of the impermeable side walls 1 of a swimming pool is provided with a pair of steps 2 according to the present invention. The steps 2 which are installed at the end of the long side 1 of the pool adjacent to a corner 3, are provided with side handrail frame members 4 and 5 between which are fixed a number of steps 6. The said handrails are hollow pipe elements, the lower end 7 of rail 4 being closed off whereas the lower end of rail 5 is provided with a telescopic sleeve 8 press fitted thereover so as to allow its length to adjust automatically to the depths of any given pool. The bottom of sleeve member 8 has partial cuts 9 therein to allow water to be sent into the interior of sleeve 8 and rail 5.

Slightly above the water level (see FIG. 1) handrail 5 is formed with a T-connection 10 normally closed by a screw cap 11. As can be seen from FIG. 3, T-connection 10 has an externally threaded end 12 of which screw cap 11 is normally applied so that suction is effected only through the cuts 9 at the bottom of sleeve 8. T-connection 10 is for the attachment of a manual suction line 13 partially indicated in FIG. 3. The end of suction line 13 is provided with a joint comprising a short length of plastic pipe 14 having an external diameter substantially identical to the internal diameter of the T-connection 10. One end of pipe 14 is inserted into line 13 and the other end is cut along a plane inclined at 45° with respect to its axis.

Figure 3:
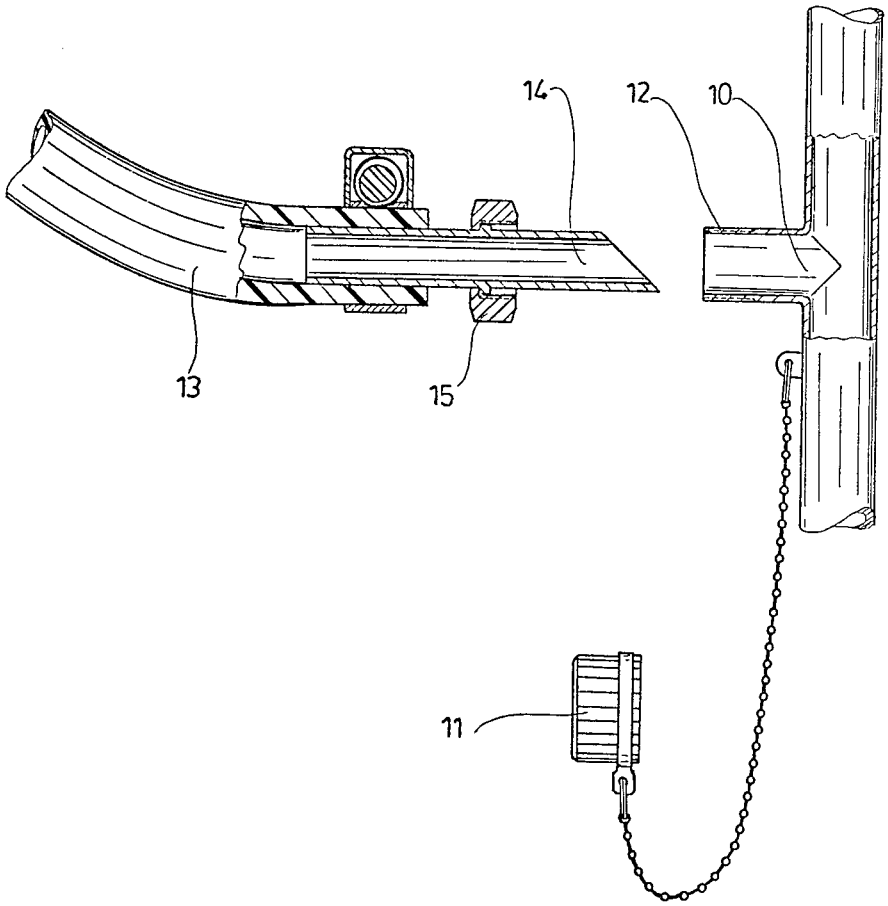
FIG. 3 shows a detail of a connection arrangement on one of the handrails of the steps.

The joint is also provided with a conventional nut connection 15 which is rotatable with respect to pipe element 14 which permits the latter to be inserted into T 12 in the relevant position as shown in FIG. 3, after which it is tightened thereover onto external thread 12. It will be observed that the 45° chamfer on the end of pipe 14 will make a substantial surface-to-surface contact with the interior of the main internal passage of handrail 5 so that the connection of wall 13 will automatically close off suction from the lower end of the handrail, applying it instead to the interior of line 13 which can then be used for local cleaning of the pool.

The other handrail 4 which is the pressure or injection side of the circulation system is provided with four principal horizontal injection ports 16 directed parallel to wall 1 of the pool away from corner 3, for injecting freshly filtered and purified water into the pool. Between main injection ports 16 it is preferred to place secondary injection ports 17 of smaller diameter which are angled at approximately 45° with respect to side wall 1 of the pool.

Figure 2:
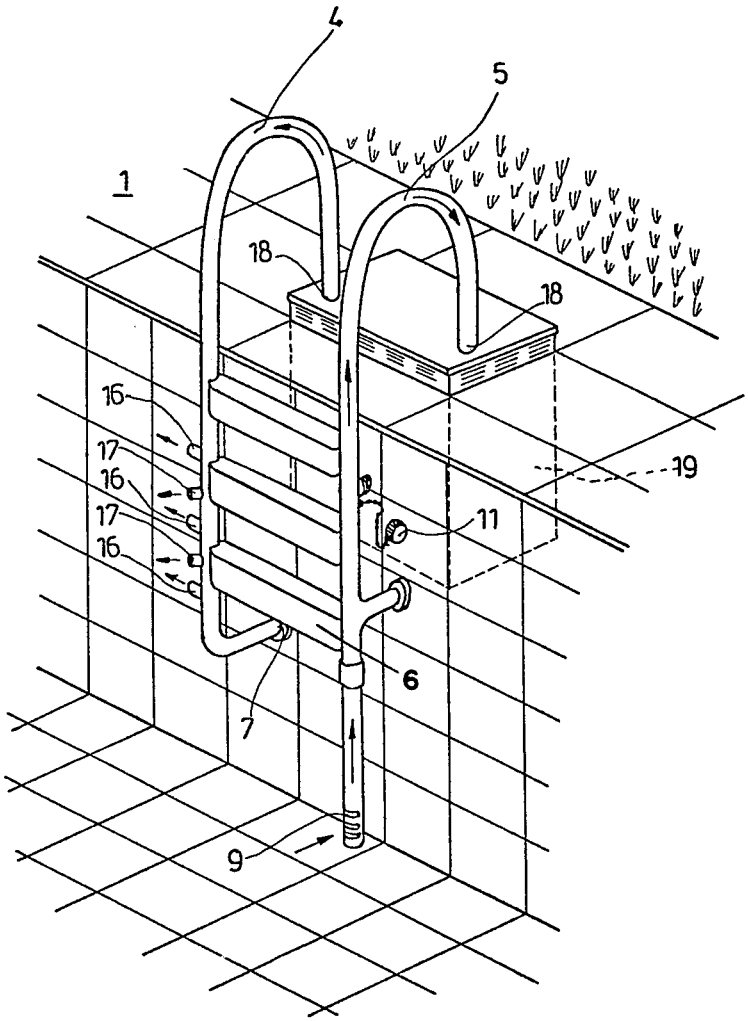
FIG. 2 is a perspective view of the steps of FIG. 1 installed in the pool.

Referring once more to FIGS. 1 and 2, the top end of handrails 4 and 5 are, as is known, curved in approximately the same circle for fixture at their free ends 18 to the edge of the pool. The fixture point on the edge of the pool is built therein on concrete block or the like 19 constructed with two L-section pipes 2, the upper ends of which are, on installation of the steps, connected by pipe joints 19 to ends 18 of the handrails. The other ends of pipes 20 are connected to circulation lines such as 21 (FIG. 1) which eventually lead to the pump-filter-purifier unit 22 installed in any suitable location, preferably near the surface of the ground and having a simple removable closure cover 23. Preferably this unit 22 is provided with bypass means for bypassing the chlorination or purification part of the unit during periods when this is considered to be unnecessary.

Figure 4:
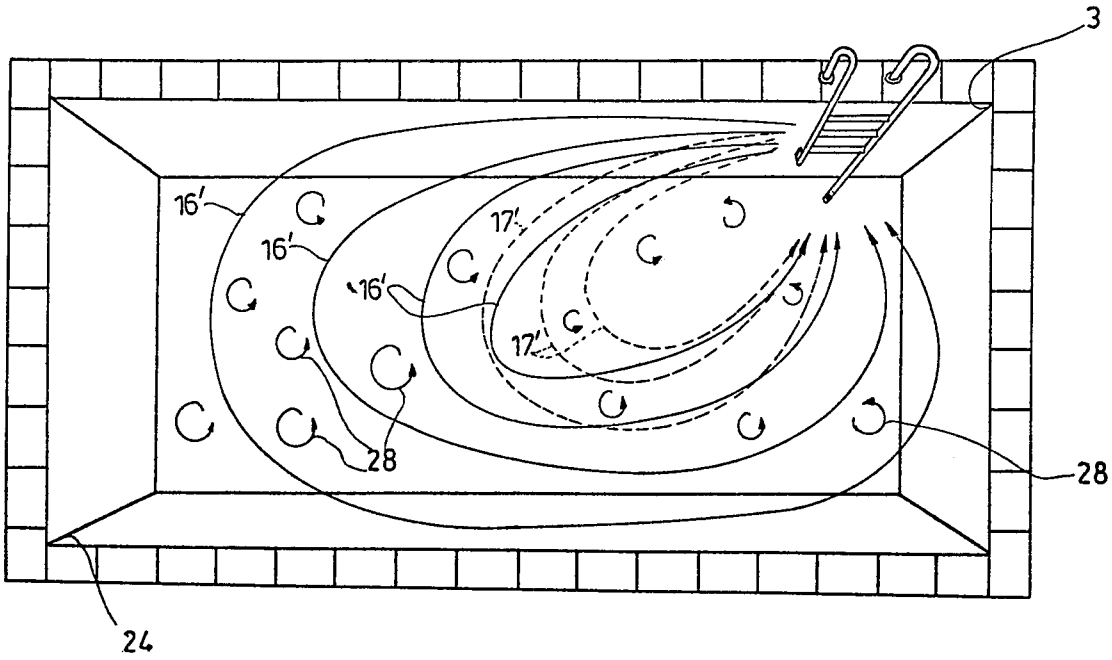
FIG. 4 is an upper plane view of a pool using the steps of FIGS. 1 and 2.

Referring specifically to FIG. 4 of the drawings, the operation of the system provides a mass displacement of the water within the pool in a manner totally different from that found in conventional pools in which there is a number of water injection points at right angles to the walls distributed therearound so as to produce substantially zero overall displacement of the water. As can be seen from FIG. 4, the arrangement of the present invention the lines of flow produced by the main water injection ports 16 are illustrated in an exemplary manner by reference number 16' whereas the flow lines resulting from the angled secondary ports 17 are illustrated by dotted lines 17'. These two flows produce a general circulating movement of the mass of water within the pool and due to the sheer forces and in a manner not totally understood at present, the surface of the pool can be observed from above to have a large number of small non-stationary eddies 28 which give the appearance of "wandering around". This multi-agitation of the mass of water within the pool effectively prevents the procreation of micro-organisms, and even over extended periods of time no slime is produced. Apart from this it has been found that much lower capacity pumps circulating correspondingly smaller quantities of water can be used in accordance with the present invention to obtain similar if not improved purification characteristics when compared with conventional systems.

For example, 12-meter private pools can very satisfactorily be purified using a single set of steps as shown in FIG. 4. When desired, it is obviously possible to use a similar set of steps on the opposite side of the pool adjacent to the opposite corner 24 (FIG. 4).

Although the present invention has been specifically described with respect to the preferred embodiment thereof, many alterations, adaptations and modifications will be obvious to those skilled in the art and it should be understood that the invention should be limited only by the scope of the following claims.

I claim:

1. Swimming pool steps comprising first and second lateral handrails and a plurality of steps connecting said handrails, said handrails comprising pipe members having respective return curves at first ends thereof for fixture to the edge of a swimming pool, said first handrail having a second lower end provided with a telescopically fitted sleeve to adjust the length of said first handrail so that said lower end abuts the bottom of the pool, said sleeve being provided with orifice means adjacent its free end, said second handrail having a closed lower end and, along the mid-section thereof, first and second series of ports, said first series being laterally directed away from said steps in a horizontal direction substantially in a plane defined by said plurality of steps, said first ends of said first and second handrails being connected respectively to suction and pressure lines of pump-filter-purifier unit means, each port of each series being below the uppermost of level of water in the pool, the ports of said second series being distributed along said midsection of said second handrail between said ports of said first series and at a forward angle of approximately 45° with respect thereto, said ports of said second series being of smaller diameter than said first series of ports.

2. Swimming pool steps comprising first and second lateral handrails and a plurality of steps connecting said handrails, said handrails comprising pipe members having respective return curves at first ends thereof for fixture to the edge of a swimming pool, said first handrail having a second lower end provided with a telescopically fitted sleeve to adjust the length of said first handrail for placement at the bottom of the pool, said sleeve being provided with orifice means therethrough adjacent its free end, said second handrail having a closed second lower end and, along the midsection thereof, a plurality of ports located below the uppermost of level of water in the pool directed laterally with respect to said first and second handrails, a first series of said ports distributed along the length of said second handrail and laterally directed away from said steps in a direction substantially in a plane defined by said steps in a direction opposite to that of said first handrail, a second series of ports distributed along said second handrail between said ports of said first series and at a forward angle with respect thereto, said ports of said first series are of greater diameter than said ports or said second series, said first ends of said first and second handrails being connected respectively to suction and pressure lines of pump-filter-purifier unit means.

3. Swimming pool steps according to claim 2, in which said first handrail is provided at a point along its length and below the uppermost of said plurality of steps with a T-connection and a cap appliable to close said connection.

4. Swimming pool steps according to claim 3 including a manual suction line having connection means at a first end thereof, said connection means comprising pipe means having an external diameter substantially equal to the internal diameter of said T-connection and a free end defining a plane of 45° with respect to the axis of said pipe means.

5. Swimming pool steps according to claim 4, in which said pipe means is provided with connection means for positively connecting said pipe means to said T-connection.

* * * * *